US008360624B2

(12) United States Patent
Otani et al.

(10) Patent No.: US 8,360,624 B2
(45) Date of Patent: Jan. 29, 2013

(54) VEHICLE HEADLAMP

(75) Inventors: Tomoaki Otani, Shizuoka (JP); Naoki Uchida, Shizuoka (JP)

(73) Assignee: Koito Manufacturing Co., Ltd., Tokyo (JP)

( * ) Notice: Subject to any disclaimer, the term of this patent is extended or adjusted under 35 U.S.C. 154(b) by 32 days.

(21) Appl. No.: 13/178,166

(22) Filed: Jul. 7, 2011

(65) Prior Publication Data

US 2012/0008334 A1 Jan. 12, 2012

(30) Foreign Application Priority Data

Jul. 8, 2010 (JP) ..... 2010-156069

(51) Int. Cl.
*F21V 7/00* (2006.01)

(52) U.S. Cl. ..... 362/518; 362/327; 362/311.02; 362/522

(58) Field of Classification Search ..... 362/296.08, 362/311.02, 311.07, 311.11, 311.15, 327, 362/516, 517, 518, 519, 520, 521, 522, 538
See application file for complete search history.

(56) References Cited

U.S. PATENT DOCUMENTS

| | | | | |
|---|---|---|---|---|
| 7,070,312 | B2 * | 7/2006 | Tatsukawa | 362/327 |
| 7,108,412 | B2 * | 9/2006 | Ishida et al. | 362/518 |
| 7,922,375 | B2 * | 4/2011 | Tatsukawa | 362/327 |
| 2012/0008333 | A1 * | 1/2012 | Otani | 362/516 |

FOREIGN PATENT DOCUMENTS

JP 2005-011704 A 1/2005

* cited by examiner

*Primary Examiner* — Y My Quach Lee
(74) *Attorney, Agent, or Firm* — Osha Liang LLP

(57) ABSTRACT

A vehicle headlamp includes a light emitting device disposed adjacent to a base point on an optical axis extending in a front-rear direction of the vehicle headlamp, and a transparent member disposed in front of the light emitting device. The light emitting device has a light emitting surface arranged to face forward. The transparent member is configured such that light emitted by the light emitting device enters the transparent member and is internally reflected by a front surface of the transparent member, and such that the light reflected by the front surface is internally reflected again by a rear surface of the transparent member and emitted from the front surface of the transparent member. The rear surface of the transparent member is configured to form horizontal and oblique cutoff lines.

4 Claims, 7 Drawing Sheets

VEHICLE HEADLAMP

CROSS-REFERENCE TO RELATED APPLICATIONS

The present application claims priority from Japanese Patent Application No. 2010-156069 filed on Jul. 8, 2010, the entire content of which is incorporated herein by reference.

BACKGROUND OF INVENTION

1. Field of the Invention

The present invention relates to a vehicle headlamp configured such that light from a light emitting device is emitted forward from a transparent member disposed in front of the light emitting device.

2. Related Art

A related art lamp unit has a light emitting device disposed adjacent to a point on an optical axis extending in the front-rear direction of a vehicle. The light emitting device is arranged such that its light emitting surface faces forward. The light from the light emitting device is emitted forward from a transparent member disposed in front of the light emitting device (see, e.g., JP 2005-11704 A).

More specifically, the light emitted from the light emitting device entered the transparent member is internally reflected by the front surface of the transparent member. The light reflected by the front surface is internally reflected again by the rear surface of the transparent member, and is emitted from another portion of the front surface. The central area of the front surface of the transparent member has a mirrored surface to internally reflect the light from the light emitting device.

According to this configuration, a slim headlamp can be provided. Further, by arranging the light emitting device such that the bottom side edge of the light emitting surface of the light emitting device is disposed on and along the horizontal line perpendicular to the optical axis, a light distribution pattern having a horizontal cutoff line at its upper end can be formed.

However, the related art lamp unit can only form a linear cutoff line extending in a single direction.

Therefore, to provide a headlamp capable of forming a low beam light distribution pattern, a lamp unit for forming a horizontal cutoff line and a lamp unit for forming an oblique cutoff line are used together.

SUMMARY OF INVENTION

One or more embodiments of the present invention provides a vehicle headlamp configured to form a low beam light distribution pattern having a horizontal cutoff line and an oblique cutoff line using a forwardly facing light emitting device and a transparent member disposed in front of the light emitting device.

According to one or more embodiments of the present invention, a vehicle headlamp is provided. The vehicle headlamp includes a light emitting device disposed adjacent to a base point on an optical axis extending in a front-rear direction of the vehicle headlamp, and a transparent member disposed in front of the light emitting device. The light emitting device includes a light emitting surface arranged to face forward. The transparent member is configured such that light emitted from the light emitting device and entered the transparent member is internally reflected by a front surface of the transparent member, and such that the light reflected by the front surface is internally reflected again by a rear surface of the transparent member and is emitted from the front surface of the transparent member. The light emitting surface includes a straight bottom side edge disposed on and along a horizontal line perpendicular to the optical axis. The front surface of the transparent member includes a flat surface perpendicular to the optical axis. The rear surface of the transparent member includes a light reflection control surface configured based on a paraboloidal reference surface having a focal point at a position symmetric with the base point with respect to the flat surface. A central area of the flat surface having a range centered at the optical axis is a mirrored surface. The light reflection control surface is a mirrored surface. The light reflection control surface includes a first zone positioned obliquely upward on an oncoming lane side or obliquely downward on an ongoing lane side with respect to the optical axis, and a second zone positioned on a horizontal plane including the optical axis. The first zone is divided into an inner zone and an outer zone by a curve line, the curve line being convex toward the optical axis when observed from a front of the headlamp. A portion of the inner zone adjacent to the curve line is configured to reflect light to form an oblique cutoff line extending obliquely upward on the ongoing lane side. The second zone is configured to reflect light to form a horizontal cutoff line extending in the horizontal direction.

The specific shape and size of the light emitting surface of the light emitting device is not limited in particular, provided that the bottom side edge of the light emitting surface extends linearly. Furthermore, the specific position of the light emitting device in the left-right direction is not limited in particular, provided that the bottom side edge of the light emitting surface thereof is disposed on and along the horizontal line perpendicular to the optical axis.

The specific shape of the light reflection control surface configured based on the paraboloidal reference surface is not limited particularly. For example, it is possible to adopt a light reflection control surface formed of a paraboloidal surface itself, a light reflection control surface formed of the paraboloidal surface on which a plurality of reflective elements are formed, or a light reflection control surface formed by deforming the paraboloidal surface.

The mirrored surface is formed, for example, by surface treatment, such as aluminum deposition, or by attaching a member having a mirror surface.

Other aspects and advantages of the invention will be apparent from the following description, the drawings and the claims.

DETAILED DESCRIPTION

Hereinafter, embodiments of the present invention will be described with reference to the drawings. In embodiments of the invention, numerous specific details are set forth in order to provide a more thorough understanding of the invention. However, it will be apparent to one of ordinary skill in the art that the invention may be practiced without these specific details. In other instances, well-known features have not been described in detail to avoid obscuring the invention.

Figure 1:
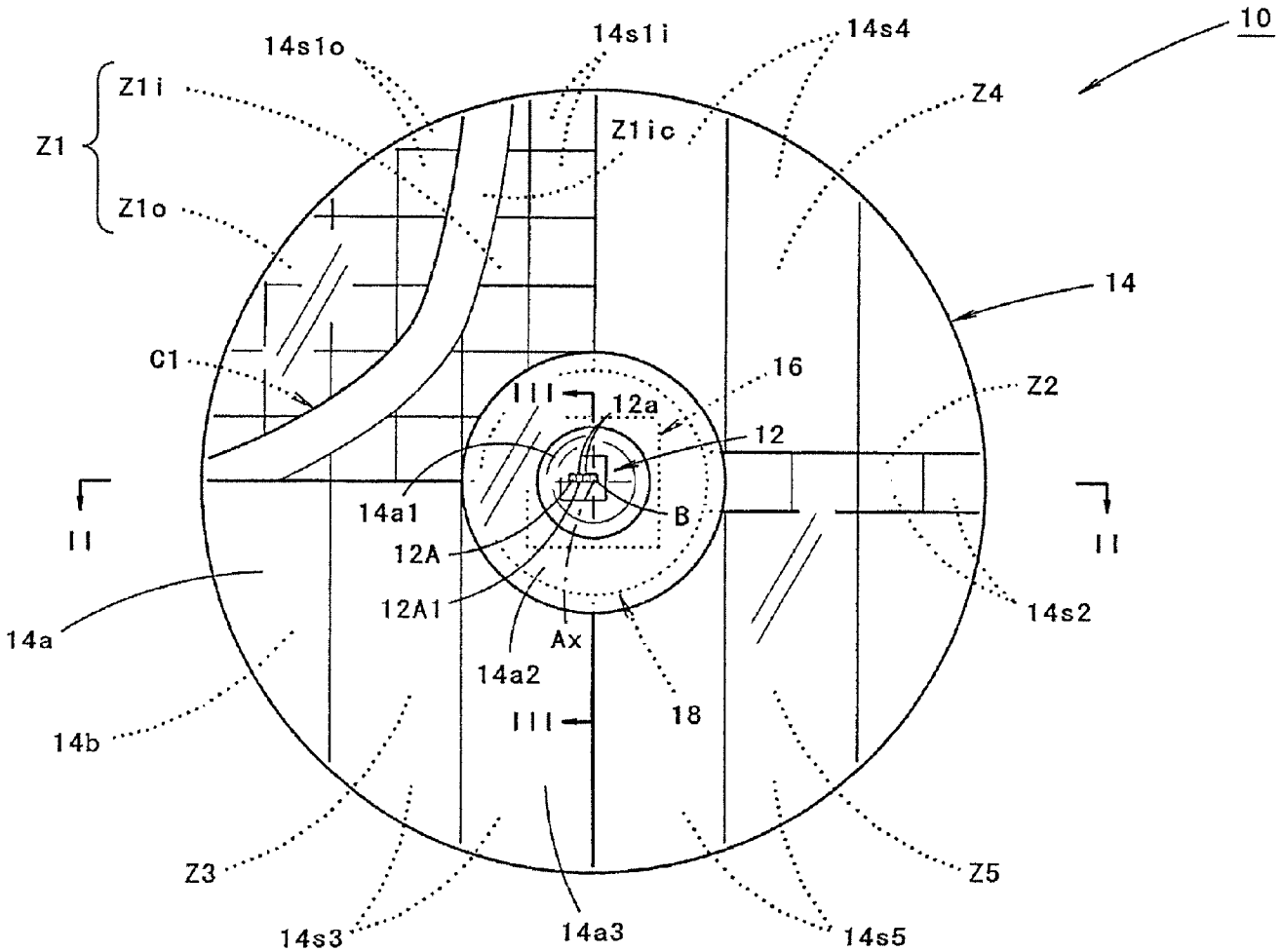
FIG. 1 is a front view of a vehicle headlamp according to one or more embodiments of the present invention.
Figure 2:
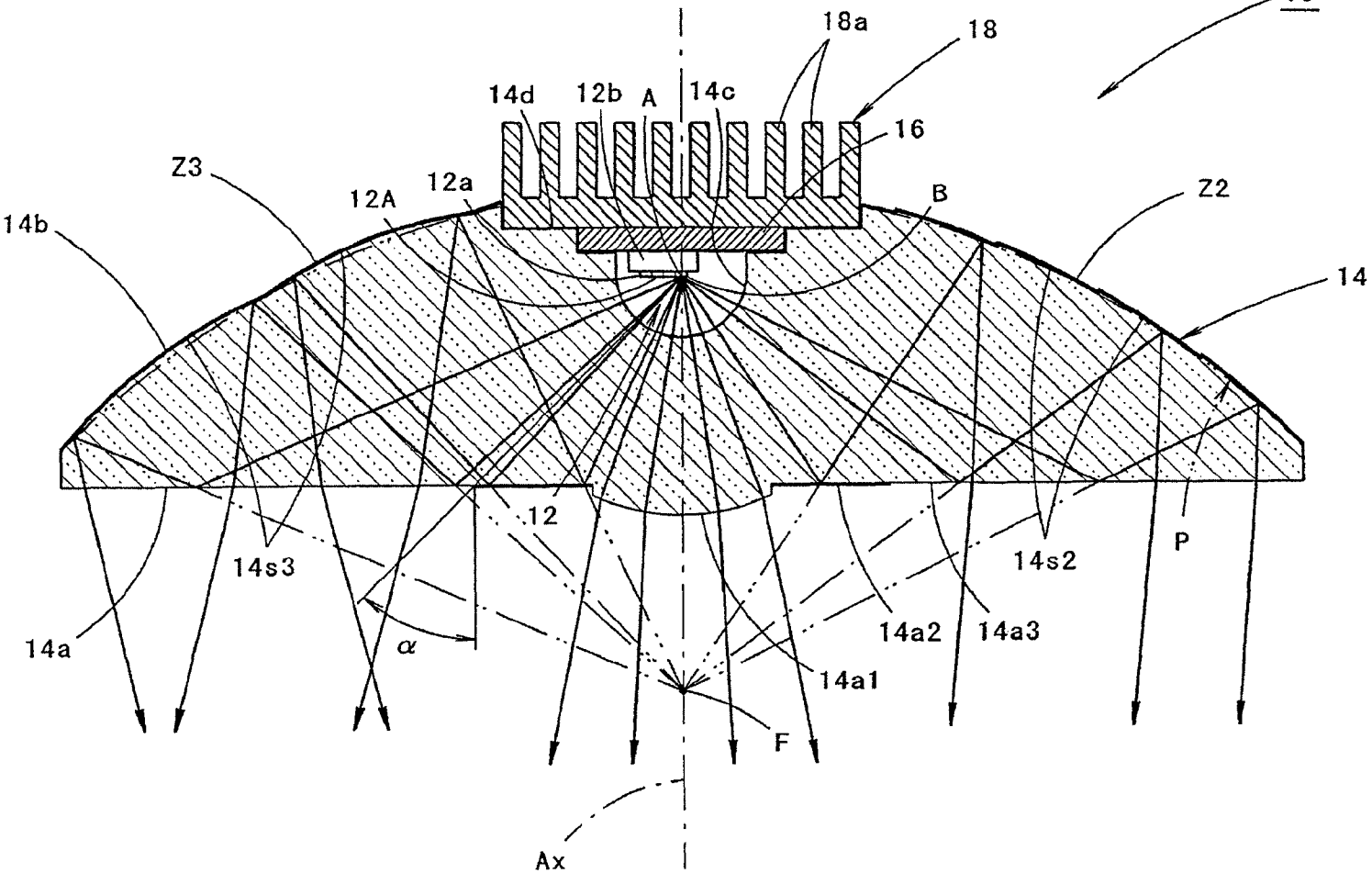
FIG. 2 is a sectional view taken along the line II-II of FIG. 1.
Figure 3:
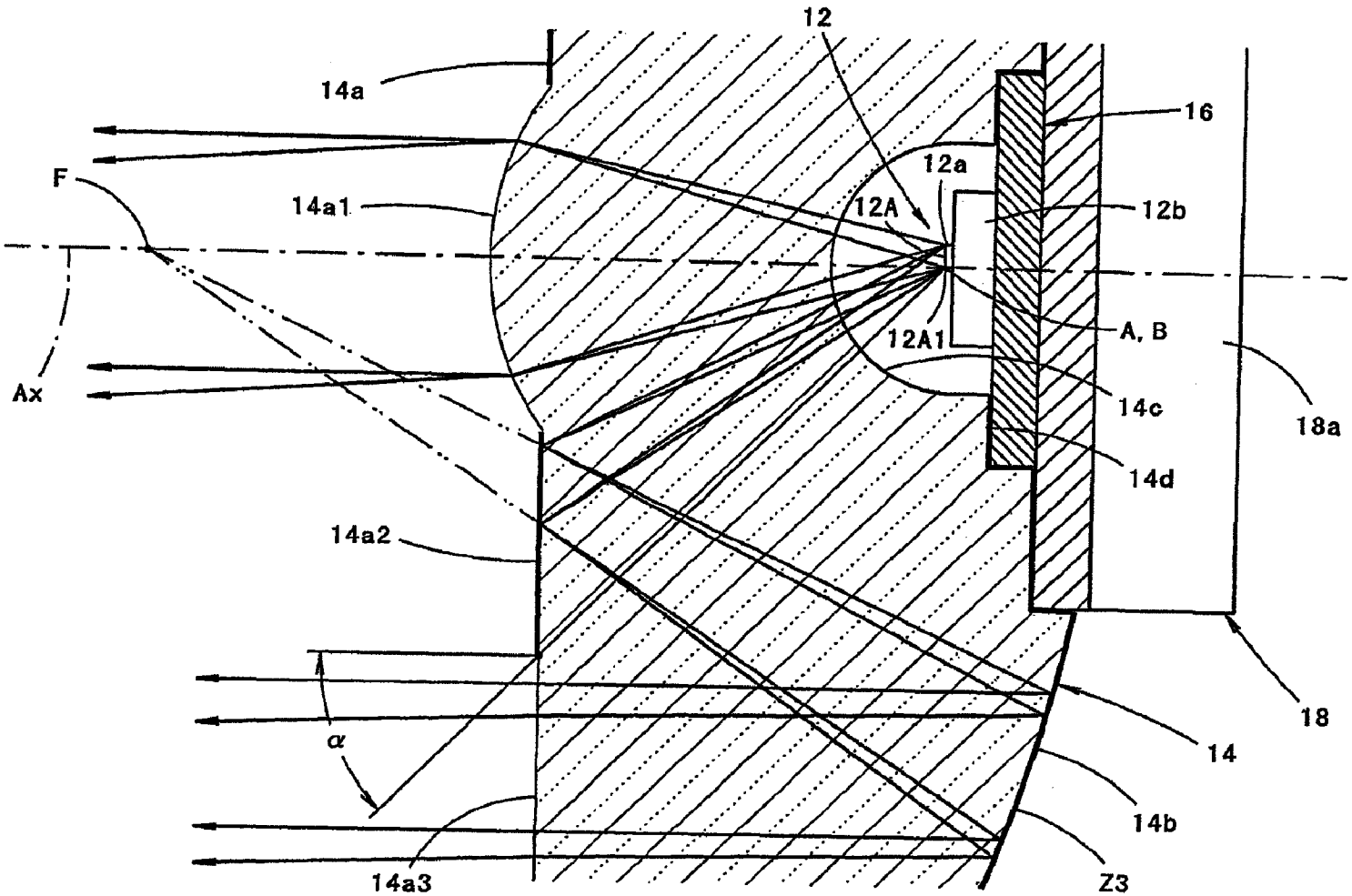
FIG. 3 is a detailed view taken along the line of FIG. 1.

As shown in FIGS. 1 to 3, a vehicle headlamp 10 according to one or more embodiments of the present invention includes a light emitting device 12 disposed adjacent to a point A on an optical axis Ax extending in the front-rear direction of the lamp, a transparent member 14 disposed in front of the light emitting device 12, a support plate 16, made of a metal, for supporting the light emitting device 12, and a heat sink 18 made of a metal and secured to the rear surface of this support plate 16. The light emitting device 12 is arranged such that the light emitting surface 12A of the light emitting device 12 faces forward.

Figure 4:
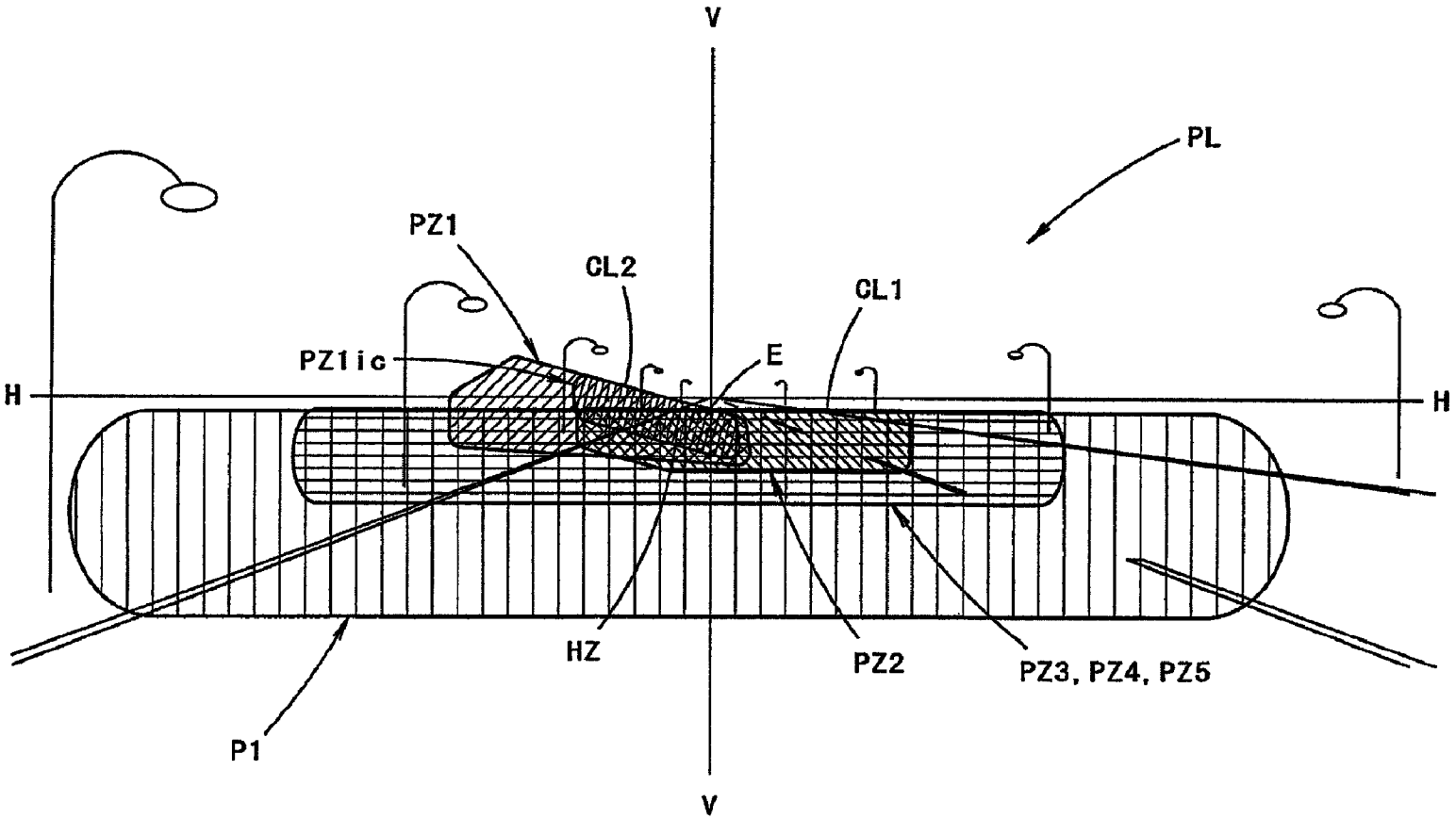
FIG. 4 is a perspective diagram illustrating a low beam light distribution pattern formed on an imaginary vertical screen disposed 25 m ahead of the headlamp by the light emitted forward from the vehicle headlamp.

This vehicle headlamp 10 is designed so as to be used in a state of being incorporated in a lamp body or the like (not shown) so that the optical axis thereof can be adjusted with respect thereto. In the state in which the optical axis adjustment is completed, the optical axis Ax extends forward of a vehicle while being inclined downward about 0.5° to 0.6°. In addition, such a left low beam light distribution pattern PL as shown in FIG. 4 is formed by irradiation light from the vehicle headlamp 10.

The light emitting device 12 is a white light-emitting diode formed of four light emitting chips 12*a* disposed in series in the horizontal direction and a substrate 12*b* for supporting these light emitting chips.

The four light emitting chips 12*a* are disposed so as to make nearly close contact with one another and the front surfaces thereof are sealed with a thin film, whereby the light emitting surface 12A for emitting light having a laterally-long rectangular shape when observed from the front of the lamp is formed. Since each of the light emitting chips 12*a* has an external shape (square) of about 1×1 mm, the light emitting surface 12A has an external shape of about 1×4 mm.

The bottom side edge 12A1 of the light emitting surface 12A of the light emitting device 12 is arranged on and along the horizontal line perpendicular to the optical axis Ax at the base point A. The end point B of the bottom side edge 12A1 on the ongoing lane side (on the right side when observed from the front of the lamp) is disposed at a position on the ongoing lane side from the optical axis Ax and near the optical axis Ax (e.g., at a position away from the optical axis Ax by about 0.3 mm to 1.0 mm).

The transparent member 14 is made of a transparent synthetic resin molded product, such as an acrylic resin molded product, and has a circular external shape when observed from the front of the lamp. The outside diameter of the transparent member 14 is about 100 mm. Furthermore, the transparent member 14 is configured such that the light emitted from the light emitting device 12 enters the transparent member 14 and is internally reflected by the front surface 14*a* thereof, and the reflected light is internally reflected again by the rear surface 14*b* thereof and is emitted forward from the front surface 14*a* thereof.

The area of the front surface 14*a* of the transparent member 14 on and near the optical axis is formed as a lens portion 14*a*1 in which the light from the light emitting device 12 is deflected and emitted, and the other area is formed as a flat surface perpendicular to the optical axis Ax.

Furthermore, an annular area 14*a*2 adjacent to the outer circumferential side of the lens portion 14*a*1 of the front surface 14*a* of the transparent member 14 is subjected to mirror finishing by aluminum deposition, for example.

The outer circumferential fringe of this annular area 14*a*2 is set at a position where the incident angle of the light emitted from the light emitting device 12 (to be more exact, the light from the base point A) and having reached the front surface 14*a* of the transparent member 14 becomes equal to the critical angle $\alpha$ of the transparent member 14. Hence, the light emitted from the light emitting device 12 and having reached the front surface 14*a* of the transparent member 14 is internally reflected by the mirror-finished reflecting surface of the annular area 14*a*2 and is totally reflected internally in a peripheral area 14*a*3 positioned on the outer circumferential side of the annular area 14*a*2.

On the other hand, the inner circumferential fringe of the annular area 14*a*2 is set at a position where the light from the light emitting device 12 (to be more exact, the light from the base point A) and internally reflected by the front surface 14*a* of the transparent member 14 enters a position substantially directly behind the outer circumferential fringe of the annular area 14*a*2.

The surface of the lens portion 14*a*1 of the front surface 14*a* of the transparent member 14 has an oval spherical shape. The curvature of the oval spherical shape of the surface is designed such that the curvature of the cross-sectional shape thereof along the horizontal plane is smaller than the curvature of the cross-sectional shape thereof along the vertical plane. Furthermore, the lens portion 14*a*1 is formed so that the light emitted from the light emitting device 12 (to be more exact, the light from the base point A) and having reached the lens portion 14*a*1 is emitted forward as light parallel with the optical axis Ax in the up-down direction and is also emitted forward as light spreading considerably to both the left and right sides from the optical axis Ax in the horizontal direction.

On the other hand, the rear surface 14*b* of the transparent member 14 includes a light reflection control surface configured based on a paraboloidal reference surface P having a focal point F at the position plane-symmetric with the base point A with respect to the front surface 14*a* and having a central axis coincident with the optical axis Ax. Furthermore, the surface of the rear surface 14*b*, except for the area around the optical axis Ax, is subjected to mirror finishing by aluminum deposition, for example.

The rear surface 14*b* of the transparent member 14 is formed so as to annularly enclose the optical axis Ax. A cavity 14*c* enclosing the light emitting device 12 is formed on the inner circumferential side of the rear surface 14*b* at the center thereof. A step-shaped recess portion 14*d* is formed around this cavity 14*c*.

The cavity 14*c* is formed into a semispherical shape centered at the base point A. Hence, the light emitted from the light emitting device 12 (to be more exact, the light emitted from the base point A) enters the transparent member 14 without being refracted. Furthermore, the step-shaped recess portion 14*d* has a shape conforming to the shapes of the support plate 16 and the heat sink 18 so as to position and fasten these components. The heat sink 18 is configured so as to have a plurality of heat dissipating fins 18*a* formed on the rear surface thereof.

Next, the specific configuration of the rear surface 14*b* of the transparent member 14 serving as the light reflection control surface will be described below.

As shown in FIG. 1, the rear surface 14*b* of the transparent member 14 is formed of a first zone Z1 positioned obliquely upward on the oncoming lane side with respect to the optical axis Ax; a second zone Z2 positioned in the vicinity of a horizontal plane including the optical axis Ax on the lateral side of the rear surface on the ongoing lane side with respect to the optical axis Ax; a third zone Z3 positioned obliquely downward on the oncoming lane side with respect to the optical axis Ax; a fourth zone Z4 positioned above the second zone Z2 on the ongoing lane side with respect to the optical axis Ax; and a fifth zone Z5 positioned below the second zone Z2 on the ongoing lane side with respect to the optical axis Ax.

The first zone Z1 is divided into an inner zone Z1*i* and an outer zone Z1*o* by a curve line C1. The curve line C1 is convex toward the optical axis Ax when observed from the front of the lamp.

The curve line C1 is obtained by, assuming that the rear surface 14*b* of the transparent member 14 is formed entirely on and along the paraboloidal reference surface P, connecting specific positions so that the light source image of the light emitting surface 12A of the light emitting device 12, formed by the light reflected by the paraboloidal reference surface, becomes a light source image having an upper line extending obliquely upward at an inclination angle of 15° toward the ongoing lane side. The curve line C1 can be approximated to a hyperbolic curve centered at the optical axis Ax when observed from the front of the lamp.

In other words, the portion of the curve line C1 that is closest to the optical axis Ax is positioned substantially in the middle between the inner circumferential fringe and the outer circumferential fringe of the rear surface 14*b* of the transparent member 14. The end point on the lower end side, intersecting the outer circumferential fringe of the rear surface 14*b*, is positioned slightly away from the vertical plane including the optical axis Ax to the oncoming lane side. Furthermore, the end point on the upper end side, intersecting the outer circumferential fringe of the rear surface 14*b*, is positioned upward slightly away from the horizontal plane including the optical axis Ax. The curve line C1 has the largest curvature at the portion closest to the optical axis Ax. The curvature of the curve line C1 becomes gradually smaller as it extends toward the end point on the upper end side and to the end point on the lower end side.

A curve line having a function similar to that of the curve line C1 is may also be present in the fifth zone Z5. This curve line in the fifth zone Z5 extends substantially symmetric with the curve line C1 with respect to the optical axis Ax.

The zone Z1*ic* (that is, a band-like zone extending in a curved manner along the curve line C1) of the inner zone Z1*i* of the first zone Z1 adjacent to the curve line C1 is formed on and along the paraboloidal reference surface P, and the remaining zone of the inner zone Z1*i* includes a plurality of deflective reflecting-elements 14*s*1*i* formed on the paraboloidal reference surface P. The width of the zone Z1*ic* adjacent to the curve line C1 is about 5 to 20 mm.

The zone Z1 is of the inner zone Z1*i* adjacent to the curve line C1 is designed such that the internally reflected light entering from the front surface 14*a* to the zone Z1*ic* is reflected in the direction parallel with the optical axis Ax. Each of the deflective reflecting-elements 14*s*1*i* of the other zones of the inner zone Z1*i* is designed such that the internally reflected light entering from the front surface 14*a* to the other zones is deflected and reflected to the ongoing lane side with respect to the direction parallel with the optical axis Ax.

On the other hand, the outer zone Z1*o* of the first zone Z1 includes a plurality of deflective reflecting-elements 14*s*1*o* formed on the paraboloidal reference surface P. Each of the deflective reflecting-elements 14*s*1*o* of the outer zone Z1*o* is designed such that the internally reflected light entering from the front surface 14*a* to the zone is deflected and reflected to the ongoing lane side in the direction parallel with the optical axis Ax.

The second zone Z2 extends in a laterally long band-like shape centered at the horizontal plane including the optical axis Ax on the lateral side of the rear surface on the ongoing lane side with respect to the optical axis Ax. The vertical width of the second zone Z2 is about 5 to 10 mm.

The second zone Z2 includes a plurality of deflective reflecting-elements 14*s*2 formed on the paraboloidal reference surface P. Each of the deflective reflecting-elements 14*s*2 of the second zone Z2 is designed such that the internally reflected light entering from the front surface 14*a* to the zone is deflected and reflected to the oncoming lane side with respect to the direction parallel with the optical axis Ax.

The third zone Z3 includes a plurality of diffusive reflecting-elements 14*s*3 formed on the paraboloidal reference surface P. Each of the diffusive reflecting-elements 14*s*3 of the third zone Z3 is designed such that the internally reflected light entering from the front surface 14*a* to the zone is diffused and reflected to both the left and right sides with respect to the direction parallel with the optical axis Ax.

The fourth zone Z4 includes a plurality of diffusive reflecting-elements 14*s*4 formed on the paraboloidal reference surface P. Each of the diffusive reflecting-elements 14*s*4 of the fourth zone Z4 is designed such that the internally reflected light entering from the front surface 14*a* to the zone is diffused and reflected to both the left and right sides with respect to the direction parallel with the optical axis Ax.

The fifth zone Z5 includes a plurality of diffusive reflecting-elements 14*s*5 formed on the paraboloidal reference surface P. Each of the diffusive reflecting-elements 14*s*5 of the fifth zone Z5 is designed such that the internally reflected light entering from the front surface 14*a* to the zone is diffused and reflected to both the left and right sides with respect to the direction parallel with the optical axis Ax.

The third and fourth zones Z3 and Z4 are configured such that the internally reflected light entering from the front surface 14*a* to the zones is only diffused and reflected to both the left and right sides. Furthermore, the fifth zone Z5 is configured such that the internally reflected light entering from the front surface 14*a* to the zone is deflected and reflected downward.

FIG. 4 is a perspective view showing the low beam light distribution pattern PL formed on an imaginary vertical screen disposed 25 m ahead of the lamp by the light emitted forward from the vehicle headlamp 10.

The low beam light distribution pattern PL is the left low beam light distribution pattern as described above and has horizontal and oblique cutoff lines CL1 and CL2 at the upper end portion thereof. The horizontal cutoff line CL1 is formed on the oncoming lane side with respect to the line V-V serving as a vertical line passing through H-V serving as a vanishing point in the front direction of the vehicle. Furthermore, the oblique cutoff line CL2 having an inclination angle of 15° is formed on the ongoing lane side. An elbow point E, the intersection of the two cutoff lines CL1 and CL2, is positioned about 0.5° to 0.6° downward from H-V, and a hot zone HZ serving as a high luminance area is formed in the vicinity of the elbow point E on the ongoing lane side. The elbow point E is positioned about 0.5° to 0.6° downward from H-V because the optical axis Ax of the vehicle headlamp 10 extends downward about 0.5° to 0.6° with respect to the front direction of the vehicle.

The low beam light distribution pattern PL is formed as a synthesized light distribution pattern obtained by superimposing six light distribution patterns PZ1 (including a light distribution pattern PZ1*ic*), PZ2, PZ3, PZ4, PZ5 and P1.

The light distribution patterns PZ1 to PZ5 are light distribution patterns formed by the light emitted after reflected by the front surface 14*a* and the rear surface 14*b* of the transparent member 14 (hereafter referred to as "repeatedly reflected light") and formed by the repeatedly reflected light from the first to fifth zones Z1 to Z5, respectively. On the other hand, the light distribution pattern P1 is a light distribution pattern formed by the light (hereafter referred as "directly emitted light") directly emitted from the lens portion 14*a*1 disposed on the front surface 14*a* of the transparent member 14.

The horizontal cutoff line CL1 of the low beam light distribution pattern PL is formed by the upper lines of the light distribution patterns PZ2 to PZ5 and P1, and is formed particularly clearly by the upper line of the light distribution pattern PZ2.

Furthermore, the oblique cutoff line CL2 of the low beam light distribution pattern PL is formed by the upper line of the light distribution pattern PZ1 and is formed particularly clearly by the upper line of the light distribution pattern PZ1*ic*.

The light distribution patterns PZ1 to PZ5 and P1 will be described below in detail.

First, the light distribution pattern PZ1 will be described below.

The light distribution pattern PZ1 has a wedged shape extending along the oblique cutoff line CL2, and its upper line is formed as a clear bright-dark border. The reason for this will be described below referring to FIGS. 5A to 5F.

FIGS. 5A to 5F are views, in the case that the first zone Z1 is entirely formed of the paraboloidal surface P, showing the light source images of the light emitting surface 12A formed by the repeatedly reflected light from a plurality of positions on the first zone Z1.

Figure 5A:
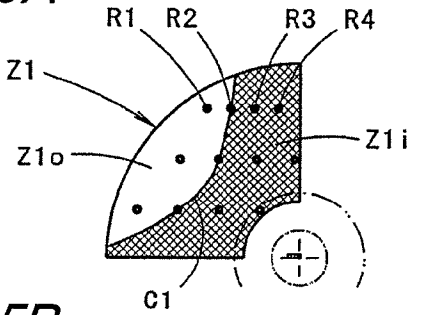
FIGS. 5A to 5F are diagrams, in the case that a first zone of the rear surface of a transparent member is a paraboloidal surface, illustrating light source images of a light emitting surface of a light emitting device formed by repeatedly reflected light from a plurality of positions on the first zone.
Figure 5B:
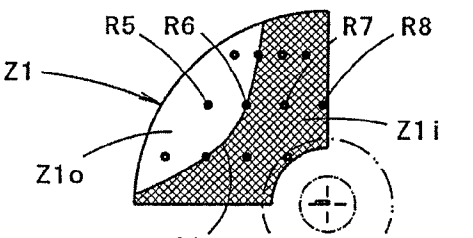
Figure 5C:
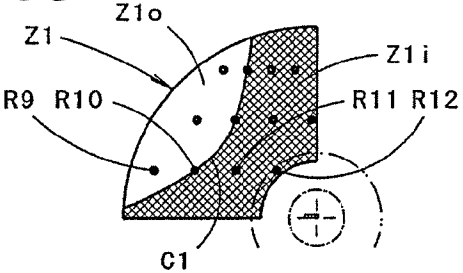

FIGS. 5A to 5C are front views showing some portions of the first zone Z1. FIG. 5A shows the positions of four reflecting points R1, R2, R3 and R4 in the upper portion of the first zone Z1, FIG. 5B shows the positions of four reflecting points R5, R6, R7 and R8 in the middle portion thereof, and FIG. 5C shows the positions of four reflecting points R9, R10, R11 and R12 in the lower portion thereof.

Figure 5D:
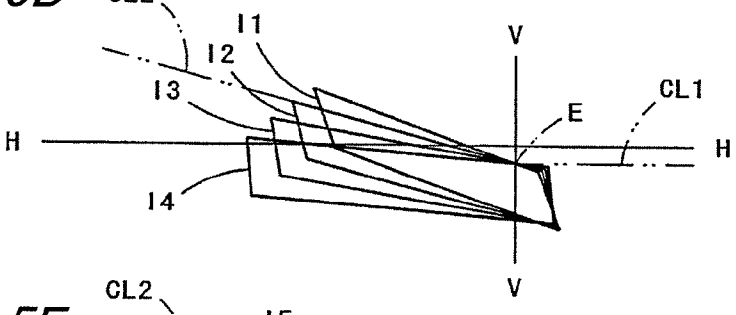

FIG. 5D is a view showing the light source images I1, I2, I3 and I4 of the light emitting surface 12A formed by the repeatedly reflected light from the positions of the four reflecting points R1, R2, R3 and R4 shown in FIG. 5A.

As shown in FIG. 5D, the light source images I1 to I4 are formed as slender images extending obliquely upward to the subject vehicle side from a position below and in the vicinity of the elbow point E.

The upper lines of these light source images I1 to I4 are formed as the light source image of the bottom side edge 12A1 of the light emitting surface 12A. Since the bottom side edge 12A1 is positioned on the horizontal line perpendicular to the optical axis Ax at the base point A, the upper lines of the light source images I1 to I4 are formed as a relatively clear bright-dark border passing through the elbow point E.

The lateral side lines of the light source images I1 to I4 on the oncoming lane side are positioned slightly on the oncoming lane side from the line V-V because the end point B of the bottom side edge 12A1 of the light emitting surface 12A is positioned on the ongoing lane side from the optical axis Ax and near the optical axis Ax.

Moreover, the light source image I1 formed by the repeatedly reflected light from the reflecting point R1 positioned closest to the oncoming lane side becomes a most inclined image. As the reflecting point is displaced from R1 to R2, R3 and R4 to the ongoing lane side, the inclination of the light source image decreases gradually from I1 to I2, I3 and I4.

The upper line of the light source image I2 formed by the repeatedly reflected light from the reflecting point R2 positioned on the curve line C1 is inclined at an inclination angle of 15° and coincides with the oblique cutoff line CL2 extending at an inclination angle of 15° from the elbow point E to the ongoing lane side. Furthermore, the upper line of the light source image I1 formed by the repeatedly reflected light from the reflecting point R1 positioned in the outer circumferential zone Z1*o* is inclined at an inclination angle of more than 15°. On the other hand, the upper lines of the light source images I3 and I4 formed by the repeatedly reflected light from the reflecting points R3 and R4 positioned in the inner zone Z1*i* are inclined at an inclination angle of less than 15°.

Figure 5E:
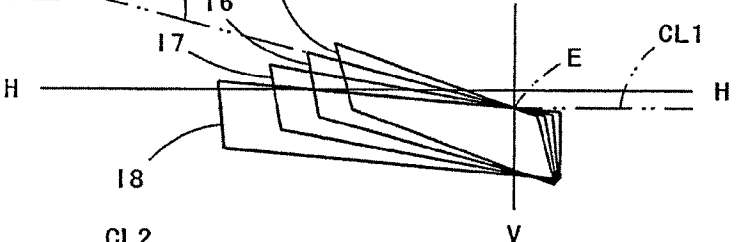

FIG. 5E is a view showing the light source images I5, I6, I7 and I8 of the light emitting surface 12A formed by the repeatedly reflected light from the positions of the four reflecting points R5, R6, R7 and R8 shown in FIG. 5B.

As shown in FIG. 5E, the light source images I5 to I8 are also formed as slender images extending obliquely upward to the subject vehicle side from a position below and in the vicinity of the elbow point E. The upper lines of the light source images I5 to I8 are formed as a relatively clear bright-dark border passing through the elbow point E, and the lateral side lines of the light source images I5 to I8 are positioned slightly on the oncoming lane side from the line V-V.

Moreover, the light source image I5 formed by the repeatedly reflected light from the reflecting point R5 positioned closest to the oncoming lane side becomes a most inclined image. As the reflecting point is displaced from R5 to R6, R7 and R8 to the ongoing lane side, the inclination of the light source image decreases gradually from I5 to I6, I7 and I8.

The upper line of the light source image I6 formed by the repeatedly reflected light from the reflecting point R6 positioned on the curve line C1 is inclined at an inclination angle of 15° and coincides with the oblique cutoff line CL2 extending at an inclination angle of 15° from the elbow point E to the ongoing lane side. Furthermore, the upper line of the light source image I5 formed by the repeatedly reflected light from the reflecting point R5 positioned in the outer circumferential zone Z1*o* is inclined at an inclination angle of more than 15°. On the other hand, the upper lines of the light source images I7 and I8 formed by the repeatedly reflected light from the reflecting points R7 and R8 positioned in the inner zone Z1*i* are inclined at an inclination angle of less than 15°.

Figure 5F:
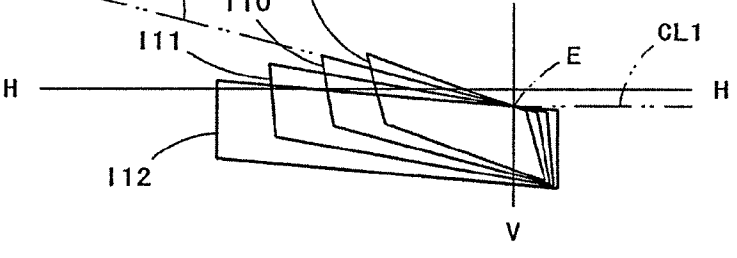

FIG. 5F is a view showing the light source images I9, I10, I11 and I12 of the light emitting surface 12A formed by the repeatedly reflected light from the positions of the four reflecting points R9, R10, R11 and R12 shown in FIG. 5C.

As shown in FIG. 5F, the light source images I9 to I12 are also formed as slender images extending obliquely upward to the subject vehicle side from a position below and in the vicinity of the elbow point E. The upper lines of the light source images I9 to I12 are formed as a relatively clear bright-dark border passing through the elbow point E, and the lateral side lines of the light source images I9 to I12 are positioned slightly on the oncoming lane side from the line V-V.

Moreover, the light source image I9 formed by the repeatedly reflected light from the reflecting point R9 positioned closest to the oncoming lane side becomes a most inclined image. As the reflecting point is displaced from R9 to R10, R11 and R12 to the ongoing lane side, the inclination of the light source image decreases gradually from I9 to I10, I11 and I12.

The upper line of the light source image I10 formed by the repeatedly reflected light from the reflecting point R10 positioned on the curve line C1 is inclined at an inclination angle of 15° and coincides with the oblique cutoff line CL2 extending at an inclination angle of 15° from the elbow point E to the ongoing lane side. Furthermore, the upper line of the light source image I9 formed by the repeatedly reflected light from the reflecting point R9 positioned in the outer circumferential zone Z1*o* is inclined at an inclination angle of more than 15°. On the other hand, the upper lines of the light source images I11 and I12 formed by the repeatedly reflected light from the reflecting point R11 and R12 positioned in the inner zone Z1*i* are inclined at an inclination angle of less than 15°.

Figures 6A, 6B, 6C:
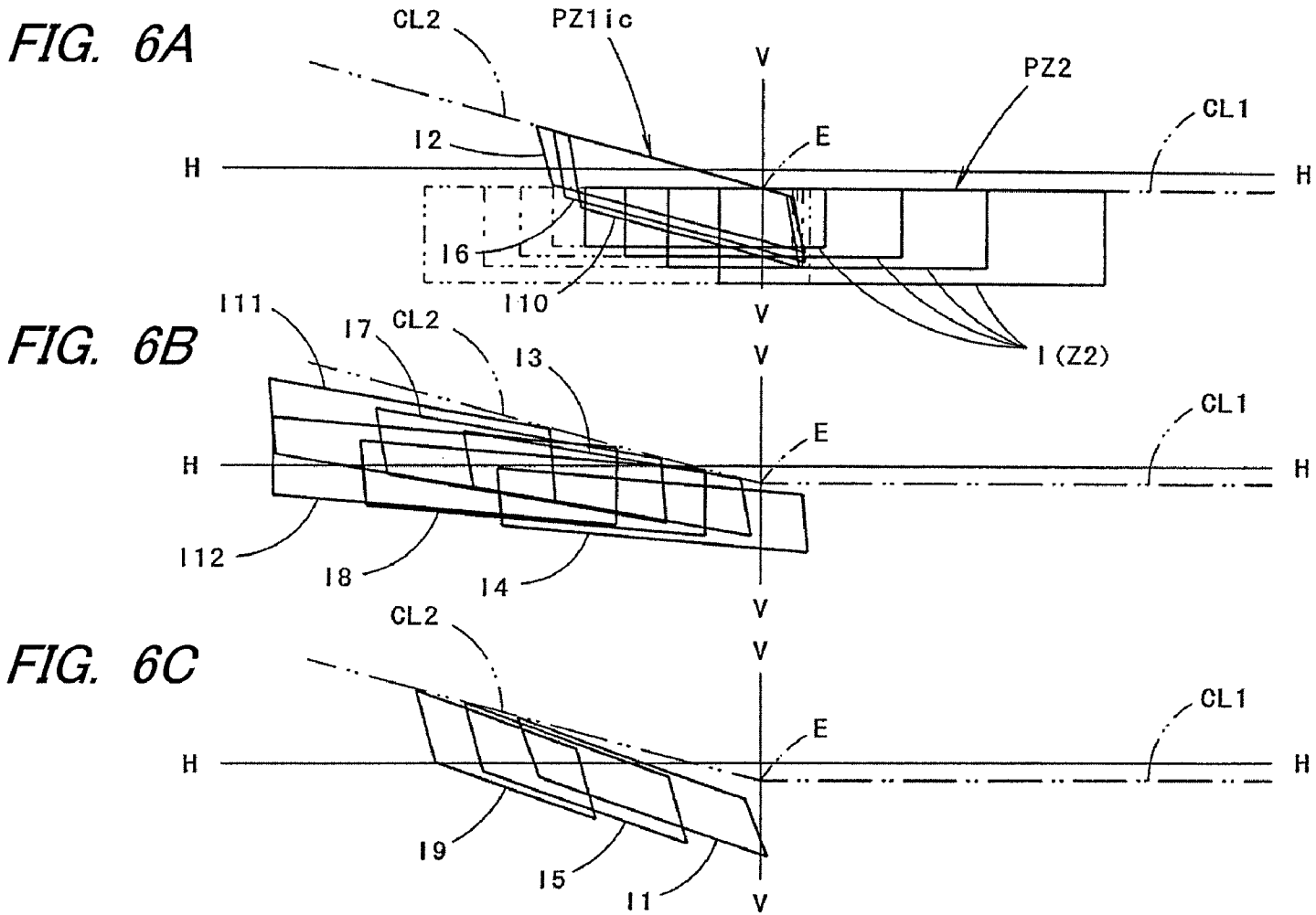
FIGS. 6A to 6C are diagrams illustrating light source images forming the low beam light distribution pattern.

FIGS. 6A to 6C are views showing a plurality of light source images I1 to I12 constituting the light distribution pattern PZ1 and a plurality of light source images I (Z2) constituting the light distribution pattern PZ2.

Since the zone Z1*ic* of the inner zone Z1*i* adjacent to the curve line C1 is formed on and along the paraboloidal reference surface P, as shown in FIG. 6A, the light source images I2, I6 and I10 (that is, the light source images, the upper lines of which have an inclination angle of 15°) formed by the repeatedly reflected light from the zone Z1*ic* are formed at the same positions as those shown in FIGS. 5D to 5F. The light source images I2, I6 and I10 are then superimposed. As a result, the light distribution pattern PZ1*ic* having a clear bright-dark border at the upper line thereof is formed, and the oblique cutoff line CL2 is formed clearly by the upper line.

The center position of the light distribution pattern PZ1*ic* in the left-right direction is slightly displaced to the ongoing lane side with respect to the line V-V because the light emitting surface 12A is disposed at a position slightly displaced to the oncoming lane side with respect to the optical axis Ax.

The zone other than the zone Z1*ic* of the inner zone Z1*i* adjacent to the curve line C1 includes the plurality of deflective reflecting-elements 14*s*1*i* formed on the paraboloidal reference surface P. Hence, as shown in FIG. 6B, the light source images I3, I4, I7, I8, I11 and I12 (that is, the light source images, the upper lines of which have an inclination angle of less than 15°) formed by the repeatedly reflected light from this zone are formed at positions displaced to the ongoing lane side from the positions shown in FIGS. 5D to 5F. The deflection angles of the respective deflective reflecting-elements 14*s*1*i* are set so that the end points of the upper lines of the light source images I3, I4, I7, I8, I11 and I12 on the oncoming lane side are arranged at positions being different from one another on the oblique cutoff line CL2.

The outer zone Z1*o* includes the plurality of deflective reflecting-elements 14*s*1*o* formed on the paraboloidal reference surface P. Hence, as shown in FIG. 6C, the light source images I1, I5 and I9 (that is, the light source images, the upper lines of which have an inclination angle of more than 15°) formed by the repeatedly reflected light from the outer zone Z1*o* are formed at positions displaced to the ongoing lane side from the positions shown in FIGS. 5D to 5F. The deflection angles of the respective deflective reflecting-elements 14*s*1*o* are set so that the end points of the upper lines of the light source images I1, I5 and I9 on the ongoing lane side are disposed at positions being different from one another on the oblique cutoff line CL2.

Furthermore, the light distribution pattern PZ1 formed by the repeatedly reflected light from the first zone Z1 has a clear bright-dark border at the upper line thereof by virtue of the light distribution pattern PZ1*ic* formed by the repeatedly reflected light from the zone Z1*ic* of the inner zone Z1*i* adjacent to the curve line C1. To this light distribution pattern are added the light distribution patterns formed by the light reflected by the other zone of the inner zone Z1*i* and from the outer zone Z1*o*. As a whole, the oblique cutoff line CL2 is formed clearly, and a light distribution pattern for brightly illuminating the area in the vicinity of the lower portion of the oblique cutoff line CL2 is obtained.

Next, the light distribution pattern PZ2 will be described below.

The light distribution pattern PZ2 is a light distribution pattern slenderly extending along the horizontal cutoff line CL1, and its upper line is formed as a clear bright-dark border. The reason for this will be described below.

That is, the bottom side edge 12A1 of the light emitting surface 12A is positioned on the horizontal plane including the optical axis Ax. Furthermore, the second zone Z2 extends in a laterally long band-like shape centered at the horizontal plane including the optical axis Ax on the lateral sides with respect to the optical axis Ax. When it is assumed that the second zone Z2 is formed on along the paraboloidal reference surface P, the plurality of light source images I (Z2) formed by the repeatedly reflected light from the second zone Z2 are formed at positions slightly away from the line V-V to the ongoing lane side while the upper lines thereof are positioned on the same horizontal plane as indicated by two-dot chain lines in FIG. 6A.

In reality, however, in the second zone Z2, the plurality of deflective reflecting-elements 14*s*2 are formed to deflect and reflect the internally reflected light entering from the front surface 14*a* to the zone toward the oncoming lane side with respect to the direction parallel with the optical axis Ax. Hence, the plurality of light source images I (Z2) are formed at positions displaced from the positions indicated by the two-dot chain lines toward the oncoming lane side as indicated by solid lines in FIG. 6A. The deflection angles of the respective deflective reflecting-elements 14*s*2 are set so that the plurality of light source images I (Z2) are arranged at positions being different from one another on the horizontal cutoff line CL1.

Next, the light distribution patterns PZ3, PZ4 and PZ5 shown in FIG. 4 will be described below.

The light distribution pattern PZ3 is a light distribution pattern formed by the repeatedly reflected light from the third zone Z3, the light distribution pattern PZ4 is a light distribution pattern formed by the repeatedly reflected light from the fourth zone Z4, and the light distribution pattern PZ5 is a light distribution pattern formed by the repeatedly reflected light from the fifth zone Z5. These are formed as light distribution patterns having a nearly identical shape.

These light distribution patterns PZ3, PZ4 and PZ5 are formed as light distribution patterns slenderly extending in the horizontal direction along the horizontal cutoff line CL1 and being larger than the light distribution pattern PZ2. The light distribution patterns PZ3 and PZ4 have a relatively clear bright-dark border on the upper lines thereof.

This is based on the fact that the repeatedly reflected light from each of the third, fourth and fifth zones Z3, Z4 and Z5 is processed as described below. In the up-down direction, as shown in FIG. 3, the light from the bottom side edge 12A1 of the light emitting surface 12A becomes light being parallel with the optical axis Ax, and the light from the other portions of the light emitting surface 12A becomes light directed downward with respect to the optical axis Ax. Furthermore, in the horizontal direction, as shown in FIG. 2, the light from the light emitting surface 12A is diffused to both the left and right sides by the plurality of diffusive reflecting-elements 14*s*3, 14*s*4 and 14*s*5.

The center position of each of the light distribution patterns PZ3, PZ4 and PZ5 in the left-right direction is slightly displaced to the ongoing lane side with respect to the line V-V because the light emitting surface 12A is disposed at a position slightly displaced to the oncoming lane side with respect to the optical axis Ax.

Furthermore, the horizontal cutoff line CL1 is formed subsidiarily by the upper lines of the light distribution patterns PZ3 and PZ4 as described above.

When it is assumed that the fifth zone Z5 is formed on and along the paraboloidal reference surface P, the light source images formed by the light reflected by the fifth zone Z5 are formed so as to protrude above the horizontal cutoff line CL1 (formed at positions approximately similar to those of the light source images I1 to I12 shown in FIGS. 5D to 5F). However, since the fifth zone Z5 is configured such that the internally reflected light entered from the front surface 14*a* to the zone is deflected and reflected downward, the light distribution pattern PZ5 can be prevented from protruding upward from the horizontal cutoff line CL1.

Next, the light distribution pattern P1 will be described below.

The light distribution pattern P1 is a light distribution pattern formed by the directly emitted light from the lens portion 14*a*1 of the front surface 14*a* of the transparent member 14.

The light distribution pattern P1 is formed as a laterally long light distribution pattern extending in the horizontal direction along the horizontal cutoff line CL1 and having a bright-dark border at the upper line thereof.

This is based on the fact that the light emitting surface 12A is formed into a laterally long rectangular shape while the bottom side edge 12A1 thereof is positioned above the horizontal plane including the optical axis Ax and that the directly emitted light from the lens portion 14*a*1 is formed as light spreading considerably to both the left and right sides.

The center position of the light distribution pattern P1 in the left-right direction is slightly displaced to the ongoing lane side with respect to the line V-V because the light emitting surface 12A is disposed at a position slightly displaced to the oncoming lane side with respect to the optical axis Ax.

As described above, the vehicle headlamp 10 is configured such that the light emitted from the light emitting device 12 disposed adjacent to the point A on the optical axis Ax extending in the front-rear direction of the lamp enters the transparent member 14 disposed in front of the light emitting device 12 and is internally reflected by the front surface 14*a* thereof, and the reflected light is then internally reflected again by the rear surface 14*b* thereof and is emitted from the front surface 14*a*. Since the light emitting device 12 is disposed so that the bottom side edge 12A1 of the light emitting surface 12A is positioned on the horizontal line perpendicular to the optical axis Ax, a light distribution pattern having the horizontal cutoff line CL1 at the upper line thereof can be formed easily.

Furthermore, the front surface 14*a* of the transparent member 14 includes a flat surface perpendicular to the optical axis Ax. The rear surface 14*b* includes the light reflection control surface configured based on the paraboloidal reference surface P having the focal point F at the position symmetric with the point A with respect to the front surface 14*a* of the transparent member 14. Hence, it is possible to find, on the paraboloidal reference surface P, specific positions wherein the light source image of the light emitting surface 12A of the light emitting device 12 formed by the light reflected by the paraboloidal reference surface P becomes a light source image having an upper line extending obliquely upward to the ongoing lane side.

Specifically, it was found that, in the rear surface 14*b* of the transparent member 14, these specific positions are on two curve lines. That is, on the curve line C1 that is convex toward the optical axis Ax when observed from the front of the lamp in the first zone Z1 positioned obliquely upward on the oncoming lane side with respect to the optical axis Ax, and on the curve line extending while being point-symmetric with the curve line C1 with respect to the optical axis Ax when observed from the front of the lamp in the fifth zone Z5 positioned obliquely downward on the ongoing lane side with respect to the optical axis Ax.

On the basis of this finding, in the rear surface 14*b* of the transparent member 14, the zone Z1*ic* of the inner zone Z1*i* of the first zone Z1 adjacent to the curve line C1 is formed as a zone in which the oblique cutoff line CL2 extending obliquely upward to the ongoing lane side is formed by the light reflected by the zone Z1*ic*, whereby the vehicle headlamp 10 according to one or more embodiments of the present invention can clearly form the oblique cutoff line CL2.

Furthermore, in the rear surface 14*b* of the transparent member 14, the second zone Z2 positioned in the vicinity of the horizontal plane including the optical axis Ax is formed of a zone in which the horizontal cutoff line CL1 extending in the horizontal direction is formed by the light reflected by the second zone Z2, whereby the vehicle headlamp 10 according to one or more embodiments of the present invention can produce the following working effects.

In other words, in the vehicle headlamp 10 according to one or more embodiments of the present invention, the light emitting device 12 is disposed so that the bottom side edge 12A1 of the light emitting surface 12A is positioned on the horizontal line perpendicular to the optical axis Ax as described above. Hence, a light distribution pattern having the horizontal cutoff line CL1 at the upper end portion thereof can be formed easily. When the second zone Z2 is formed on and along the paraboloidal reference surface P, the upper lines of the light source images I (Z2) of the light emitting surface 12A formed by the light reflected by the second zone Z2 positioned in the vicinity of the horizontal plane including the optical axis Ax are positioned on nearly the same horizontal plane. Thus, the horizontal cutoff line CL1 can be formed clearly by selecting the second zone Z2 as a zone in which the horizontal cutoff line CL1 is formed by the light reflected by the second zone Z2.

With one or more embodiments of the present invention, in the vehicle headlamp 10 configured such that the light from the light emitting device 12 is emitted forward from the transparent member 14 disposed in front of the light emitting device 12, the low beam light distribution pattern PL having the horizontal and oblique cutoff lines CL1 and CL2 can be formed by the irradiation light of the lamp. In addition, the horizontal and oblique cutoff lines CL1 and CL2 can be formed clearly.

Furthermore, with one or more embodiments of the present invention, in the light distribution pattern PZ1 formed by the repeatedly reflected light from the first zone Z1, the light distribution patterns formed along the oblique cutoff line CL2 by the light reflected by the other zone of the inner zone Z1*i* and from the outer zone Z1*o* are added to the light distribution pattern PZ1*ic* formed by the repeatedly reflected light from the zone Z1*ic* of the inner zone Z1*i* adjacent to the curve line C1. Hence, while the oblique cutoff line CL2 is formed clearly, the area in the vicinity of the lower portion of the oblique cutoff line CL2 can be illuminated brightly. As a result, it is possible to securely obtain sufficient brightness around the hot zone HZ.

Furthermore, in one or more embodiments of the present invention, the fifth zone Z5 of the rear surface 14*b* of the transparent member 14 is configured such that the internally reflected light entered from the front surface 14*a* of the transparent member 14 to the zone is deflected and reflected downward. Hence, light source images protruding upward from the horizontal and oblique cutoff lines CL1 and CL2 are prevented beforehand from being formed while the fifth zone Z5 is not required to be subjected to a non-reflection treatment or the like.

The fifth zone Z5 is configured such that the internally reflected light entered from the front surface 14*a* of the transparent member 14 to the zone is deflected downward and reflected in the horizontal direction. Hence, it is possible to effectively suppress that unevenness in light distribution on the road surface ahead of the vehicle is generated by light source images displaced downward by the downward deflection and reflection on the fifth zone Z5.

With one or more embodiments of the present invention, the light emitting device 12 is disposed so that the end point B of the bottom side edge 12A1 of the light emitting surface 12A thereof on the ongoing lane side is disposed at a portion on the ongoing lane side from the optical axis Ax and in the vicinity of the optical axis Ax. Hence, the light source image formed by the light reflected by the inner zone Z1*i* of the first zone Z1 serving as a zone in which the oblique cutoff line CL2 is formed can be formed at a position in the vicinity of the elbow point E on the ongoing lane side. As a result, it is possible to form the hot zone HZ of the low beam light distribution pattern PL at an appropriate position.

Furthermore, with the light emitting device 12 disposed as described above, the light source images I (Z2) that is formed by the light reflected by the second zone Z2 in which the horizontal cutoff line CL1 is formed can also be formed at positions in the vicinity of the elbow point E on the ongoing lane side in the case that the second zone Z2 is formed on and along the paraboloidal reference surface P. Moreover, in one or more embodiments of the present invention, the surface shape of the second zone Z2 is formed so that the light source images I (Z2) are displaced appropriately to the ongoing lane side. Hence, the horizontal cutoff line CL1 can be formed clearly and the hot zone HZ can securely obtain sufficient luminance.

In addition, in one or more embodiments of the present invention, the central area of the front surface 14*a* of the transparent member 14 is set as the annular area 14*a*2 centered at the optical axis Ax, and the area in the vicinity of the optical axis positioned on the inner circumferential side of the annular area 14*a*2 is formed as the lens portion 14*a*1 in which the light emitted from the light emitting device 12 and having reached the area is deflected and emitted. Hence, the light distribution pattern P1 formed by the light emitted from the lens portion 14*a*1 can be formed by adding the light distribution pattern P1 formed by the light emitted from the lens portion 14*a*1 to the light distribution patterns PZ1 to PZ5 formed by the light internally reflected by the rear surface 14*b* of the transparent member 14. Hence, the light flux of the light source can be used effectively.

Furthermore, the lens portion 14*a*1 is configured such that the light from the light emitting device 12 is emitted as light diffused in the left-right direction. Hence, the light distribution pattern P1 being relatively dark and large is formed as a laterally long light distribution pattern around the light distribution patterns PZ1 to PZ5 being relatively bright and small and formed by the light internally reflected by the rear surface 14*b* of the transparent member 14. As a result, the low beam light distribution pattern PL formed by the irradiation light from the vehicle headlamp 10 can be formed as a light distribution pattern having little unevenness in light distribution.

In one or more embodiments of the present invention above, it is described that the light emitting device 12 has the light emitting surface 12A having a laterally-long rectangular shape. However, the light emitting device 12 can be configured so as to have the light emitting surface 12A having a shape other than the rectangular shape, as a matter of course.

Figure 7B:
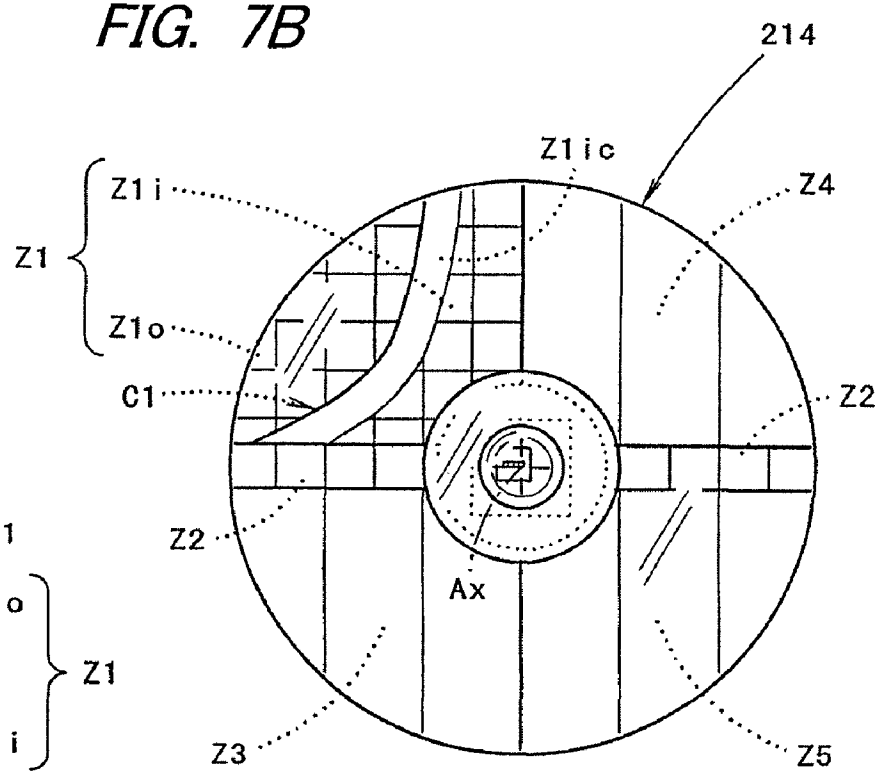
FIG. 7B is a front view of a headlamp according to one or more embodiments of the present invention.
Figure 7A:
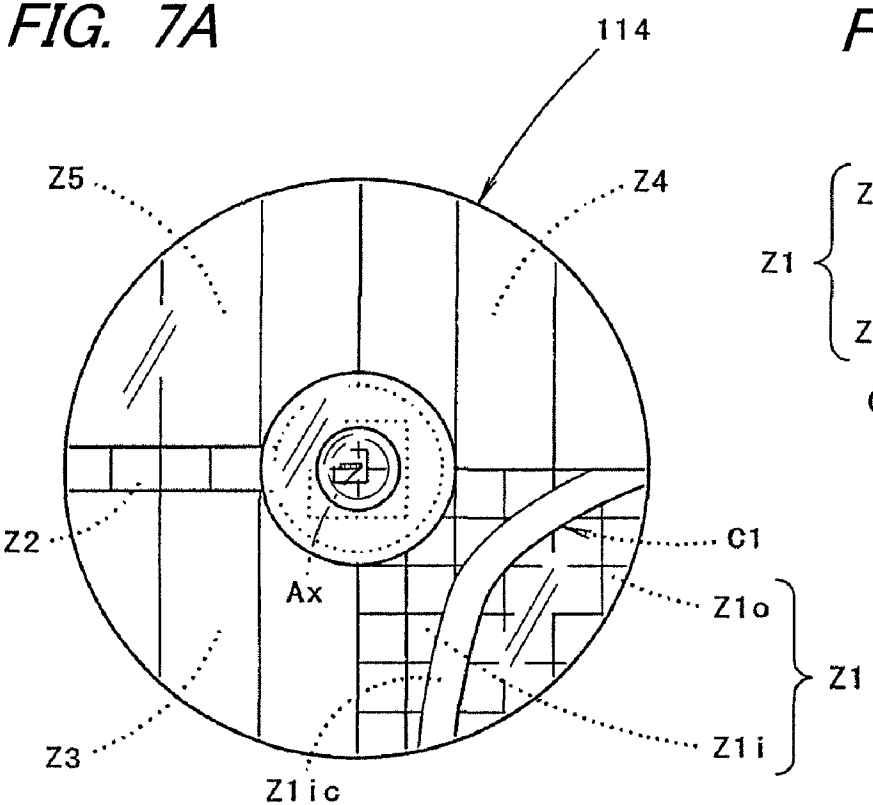
FIG. 7A is a front view of a headlamp according to one or more embodiments of the present invention.

In one or more embodiments of the present invention above, it is described that the first zone Z1 of the rear surface 14*b* of the transparent member 14 is positioned obliquely upward on the oncoming lane side with respect to the optical axis Ax. However, the first zone Z1 can also be configured so as to be positioned obliquely downward on the ongoing lane side with respect to the optical axis Ax as in the case of a transparent member 114 shown in FIG. 7A.

In one or more embodiments of the present invention above, it is described that the second zone Z2 of the rear surface 14*b* of the transparent member 14 is positioned on the lateral side of the rear surface on the ongoing lane side. However, the second zone Z2 can also be configured so as to be positioned on the lateral side of the rear surface on the oncoming lane side as in the case of the transparent member 114 shown in FIG. 7A. Furthermore, the second zone Z2 can also be configured so as to be positioned on the lateral sides of the rear surface on the ongoing lane side and the oncoming lane side as in the case of a transparent member 214 shown in FIG. 7B.

While description has been made in connection with embodiments of the present invention, it will be obvious to those skilled in the art that various changes and modification may be made therein without departing from the present invention as defined by the appended claims. While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A vehicle headlamp comprising:

a light emitting device disposed adjacent to a base point on an optical axis extending in a front-rear direction of the vehicle headlamp; and a transparent member disposed in front of the light emitting device, wherein the light emitting device comprises a light emitting surface arranged to face forward, wherein the transparent member is configured such that light emitted by the light emitting device enters the transparent member and is internally reflected by a front surface of the transparent member, and such that the light reflected by the front surface is internally reflected again by a rear surface of the transparent member and is emitted from the front surface of the transparent member, wherein the light emitting surface comprises a straight bottom side edge disposed on and along a horizontal line perpendicular to the optical axis, wherein the front surface of the transparent member comprises a flat surface perpendicular to the optical axis, wherein the rear surface of the transparent member comprises a light reflection control surface configured based on a paraboloidal reference surface having a focal point at a position symmetric with the base point with respect to the flat surface, wherein a central area of the flat surface has a range centered at the optical axis and is a mirrored surface, and wherein the light reflection control surface is a mirrored surface, wherein the light reflection control surface comprises a first zone positioned obliquely upward on an oncoming lane side or obliquely downward on an ongoing lane side with respect to the optical axis, and a second zone positioned on a horizontal plane including the optical axis, wherein the first zone is divided into an inner zone and an outer zone by a curve line, the curve line being convex toward the optical axis when observed from a front of the headlamp, wherein a portion of the inner zone adjacent to the curve line is configured to reflect light to form an oblique cutoff line extending obliquely upward on the ongoing lane side, and wherein the second zone is configured to reflect light to form a horizontal cutoff line extending in the horizontal direction.

2. The vehicle headlamp according to claim 1, wherein an end point of the bottom side edge of the light emitting surface on the ongoing lane side is disposed at a position on the ongoing lane side from the optical axis and near the optical axis.

3. The vehicle headlamp according to claim 1, wherein the light emitting device comprises a plurality of light emitting chips disposed in series in the horizontal direction.

4. The vehicle headlamp according to claim 3, wherein the plurality of light emitting chips are disposed so as to make nearly close contact with one another and front surfaces thereof are sealed with a thin film, whereby the light emitting surface for emitting light having a laterally-long rectangular shape when observed from the front of the headlamp is formed.

* * * * *